US007084577B2

(12) United States Patent
Maede et al.

(10) Patent No.: US 7,084,577 B2
(45) Date of Patent: Aug. 1, 2006

(54) ORGANIC EL ELEMENT DRIVE CIRCUIT AND ORGANIC EL DISPLAY DEVICE USING THE SAME DRIVE CIRCUIT

(75) Inventors: Jun Maede, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 289 days.

(21) Appl. No.: 10/677,328

(22) Filed: Oct. 3, 2003

(65) Prior Publication Data

US 2004/0085025 A1 May 6, 2004

(30) Foreign Application Priority Data

Oct. 8, 2002 (JP) ..... 2002-294634

(51) Int. Cl.
*G09G 3/10* (2006.01)

(52) U.S. Cl. ..... 315/169.4; 345/77

(58) Field of Classification Search ..... 315/169.2, 315/169.3, 169.4; 345/72, 76, 77
See application file for complete search history.

(56) References Cited

U.S. PATENT DOCUMENTS

| | | | | |
|---|---|---|---|---|
| 6,774,878 | B1 * | 8/2004 | Yoshida et al. | 345/76 |
| 2002/0021483 | A1 * | 2/2002 | Katase | 359/267 |
| 2003/0052842 | A1 * | 3/2003 | Yoshida et al. | 345/76 |
| 2005/0030264 | A1 * | 2/2005 | Tsuge et al. | 345/76 |

FOREIGN PATENT DOCUMENTS

| | | |
|---|---|---|
| JP | 9-232074 | 9/1997 |
| JP | 2001-143867 | 5/2001 |

* cited by examiner

*Primary Examiner*—Wilson Lee
*Assistant Examiner*—Minh Dieu A
(74) *Attorney, Agent, or Firm*—Mattingly, Stanger, Malur & Brundidge, P.C.

(57) ABSTRACT

A timing control signal for separating a display time period corresponding to one line horizontal scan period and a reset time period corresponding to a retrace period of horizontal scan is provided for each of R, G and B display colors. The display time periods for R, G and B display colors are determined by setting the reset time periods of the timing control signals according to externally set data, so that luminance for each display color is regulated.

16 Claims, 3 Drawing Sheets

ORGANIC EL ELEMENT DRIVE CIRCUIT AND ORGANIC EL DISPLAY DEVICE USING THE SAME DRIVE CIRCUIT

BACKGROUND OF THE INVENTION

1. Field of the Invention

The present invention relates to an organic EL (electro luminescence) element drive circuit and an organic EL display device using the same drive circuit and, in particular, the present invention relates to an organic EL display device suitable for high luminance color display, which can precisely regulate white balance on a display screen of a display device of an electronic device such as a portable telephone set or a PHS by regulating luminance of each of R (red), G (green) and B (blue) display colors, regardless of smallness of dynamic range of regulation of a reference current value of each of R, G and B colors.

2. Description of the Prior Art

An organic EL display panel of an organic EL display device mounted on a portable telephone set, a PHS, a DVD player or a PDA (personal digital assistance) and having 396 (132×3) terminal pins for column lines and 162 terminal pins for row lines has been proposed and there is a tendency that the number of column lines and the number of row lines are further increased.

An output stage of a current drive circuit of such organic EL display panel includes an output circuit constructed with, for example, current-mirror circuits, which are provided correspondingly to the respective terminal pins, regardless of the drive current type, the passive matrix type or the active matrix type.

One of problems of the organic EL display device is that, when the voltage drive is used as in a liquid crystal display device, it is difficult to control a display because of large variation of luminance and difference in light emission sensitivity between R, G and B colors. For this reason, the organic EL display device should be current-driven. However, even when the current-drive is employed, light emission efficiency ratio of drive currents for R, G and B colors is, for example, R:G:B=6:11:10, which depends upon materials of the organic EL elements.

In view of this, it is necessary in the current-drive circuit for color display that white balance is obtained on a display screen by regulating luminance of each of R, G and B colors correspondingly to materials of the EL elements for respective R, G and B colors. In order to realize such white balance regulation, a regulation circuit for regulating luminance of each of respective R, G and B colors on the display screen is provided.

Incidentally, JPH9-232074A discloses a drive circuit for organic EL elements, in which each of the organic EL elements arranged in a matrix is current-driven and a terminal voltage of the organic EL element is reset by grounding an anode and a cathode of the organic EL element. Further, JP2001-143867A discloses a technique with which power consumption of an organic EL display device is reduced by current-driving organic EL elements by using DC-DC converters.

It is usual that the current-drive circuit of the organic EL display device generates drive currents for organic EL elements at respective column pins (column side terminal pins of an organic EL panel) by current-amplifying reference currents for R, G and B display colors and the regulation of drive-currents for obtaining white balance is performed by regulating the reference currents for R, G and B display colors.

In order to regulate the reference currents for R, G and B display colors, each of reference current generator circuits of a conventional drive current regulator circuit includes a D/A converter circuit of, for example, 4 bits and the reference currents for R, G and B display colors are regulated by setting a predetermined bit data for each of R, G and B display colors within a range, for example, from 30 μA to 75 μA. With the fact that various organic EL materials have been developed recently, the luminance regulation for realizing white balance, which is realizable by the D/A converter circuits, is not enough since the dynamic range of regulation is as small as 4 bits.

However, if the number of bits of the D/A converter circuit for luminance regulation of each of R, G and B display colors is increased to a value in a range, for example, from 6 bits to 8 bits in order to enlarge the dynamic range of regulation, the circuit size becomes large, so that it becomes difficult to fabricate the current drive circuits in one chip. Further, the miniaturization of a display device portion becomes impossible.

SUMMARY OF THE INVENTION

An object of the present invention is to provide an organic EL element drive circuit, with which regulation of white balance on a screen of an organic EL display device of an electronic device by luminance regulation of R, G and B display colors is facilitated, and an organic EL display device using an organic EL element drive circuit, which is identical to the same organic EL element drive circuit.

Another object of the present invention is to provide an organic EL element drive circuit capable of finely regulating white balance regardless of smallness of dynamic range of a reference current for each of R, G and B display colors and an organic EL display device using an organic EL element drive circuit, which is identical to the same organic EL element drive circuit.

In order to achieve the above objects, an organic EL element drive circuit according to the present invention for current-driving organic EL elements through terminal pins provided correspondingly to R, G and B display colors of an organic EL display panel in a display period and resetting terminal voltages of the organic EL elements in a reset period, according to a timing control signal for regulating the display period corresponding to one horizontal scan period and the reset period corresponding to a retrace period of the horizontal scan, is featured by comprising a pulse generator circuit for generating the timing control signal having the reset period, which is set according to data set externally of the pulse generator circuit, correspondingly to respective R, G and B display colors, a display luminance of each display color on a screen of the organic EL display panel being regulated according to the data.

The resetting of the terminals of the organic EL elements is performed by precharging the terminal pins to the constant voltage. Therefore, a waveform of a drive current for driving the organic EL element, which is supplied to each column pin of the organic EL element drive circuit has a peak current starting from the predetermined constant current as shown by a solid curve in FIG. 3(*g*). Incidentally, a dotted curve in FIG. 3(*g*) shows a voltage waveform.

This constant voltage resetting is performed for a reset time period RT corresponding to the retrace period of the horizontal scan and the display time period D corresponds to one line horizontal scan period. The sectioning of the display time period D and the reset time period RT is performed by the reset control pulse (timing control pulse) having a period (corresponding to a horizontal scan frequency) corresponding to (display time period D+reset time period RT). Incidentally, FIG. 3 shows the waveforms of drive currents supplied to the respective terminal pins and the timing signal for generating these drive currents.

Describing FIG. 3 in detail, FIG. 3(*a*) shows a sync clock CLK forming a base of the timing of control signals and FIG. 3(*b*) shows a count start pulse CSTP of a pixel counter, count value of which is shown in FIG. 3(*c*). FIG. 3(*d*) shows a display start pulse DSTP and FIG. 3(*e*), FIG. 3(*h*) and FIG. 3(*i*) show the reset control pulses RSR for R display color, RSG for G display color and RSB for B display color, respectively.

In the present invention, the reset period RT of the reset control pulses for R, G and B display colors are made different to make the end time points of the display periods for R, G and B display colors different.

In other words, according to the present invention, the white balance regulation is performed by regulating the end time points of the display time period D of R, G and B display colors by externally setting the reset time period RT for R, G and B display colors and regulating luminance of each display color on a display screen.

As a result, it is possible to realize an organic EL element drive circuit capable of regulating white balance regardless of smallness of dynamic range of regulation of reference current values for R, G and B display colors or even without necessity of the reference current regulation.

BRIEF DESRIPTION OF THE DRAWINGS

DETAILED DESCRIPTION OF THE PREFERRED EMBODIMENTS

Figure 1:
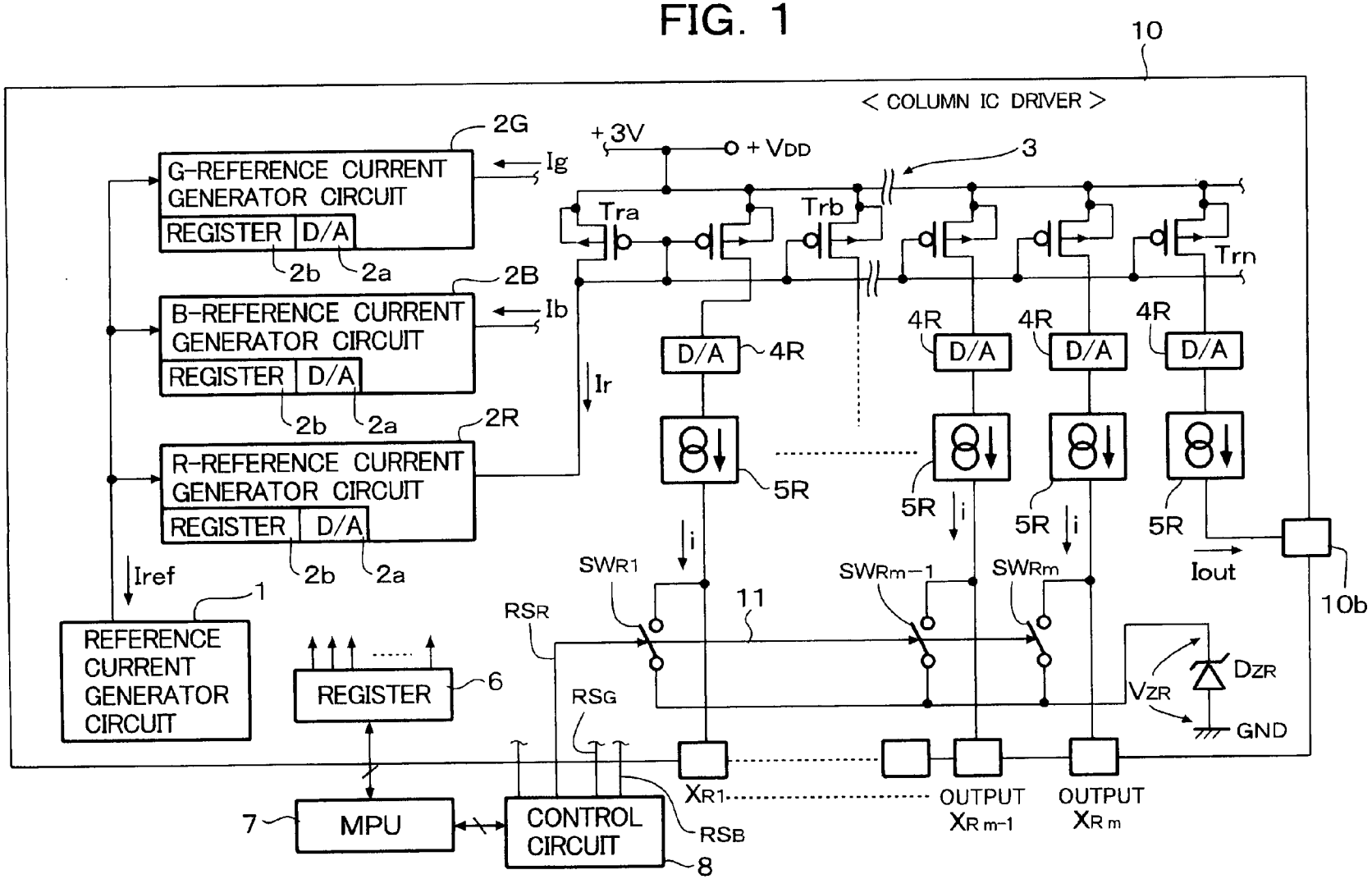
FIG. 1 is a block circuit diagram of an organic EL display panel including an organic EL element drive circuit as a column driver thereof, according to an embodiment of the present invention.

FIG. 1 shows an embodiment of an organic EL drive circuit according to the present invention. In FIG. 1, a column driver 10 as the organic EL element drive circuit of an organic EL display panel, which is provided as an IC chip, includes a reference current generator 1, a reference current generator circuit 2R (R-reference current generator circuit 2R) provided correspondingly to R display color, a reference current generator circuit 2G (G-reference current generator circuit 2G for G display color, a reference current generator circuit 2B (B-reference current generator circuit 2B) for B display color and three current mirror circuits 3 connected to the respective reference current generator circuits 2R, 2G and 2B. Since the current mirror circuits 3 have identical constructions and operate similarly, only the current mirror circuit 3 for R display color will be described mainly.

Each reference current generator circuit includes an input stage current mirror circuit (not shown), a D/A converter circuit 2*a* of, for example, 4 bits and a register 2*b*. The registers 2*b* store 4-bit data supplied externally through an MPU 7, respectively. The input stage current mirror circuits of the reference current generator circuits 2R, 2G and 2B are supplied with a reference current Iref generated by the reference current generator 1 and the D/A converter circuits 2*a* regulate the Iref according to the data stored in the registers 2*b* and set in the D/A converters 2*a* to generate reference currents Ir, Ig and Ib of R, G and B display colors for white balance regulation, respectively.

The reference current generator circuit 2R generates a reference current Ir by the reference current Iref form the reference current generator 1. The reference currents Ir is supplied to input side transistors Tra of the current mirror circuit 3 for R display color. Thus, reference currents Ir to distribute to output terminals XR1 to XRm for R display color of the organic EL element drive circuit are generated at each output side transistors Trb to Trn.

Now, an operation of the column driver 10 will be described with reference to the circuit for R display color shown in FIG. 1.

The current mirror circuit 3 includes an input side transistor Tra and P channel MOS FET Trb to Trn. Sources of the transistors Trb to Trn are connected to a power source line +VDD (=+3V).

Drains of the transistors Trb to Trn are connected to D/A converters 4R, respectively, and output currents Ir from the drains become reference drive currents of the respective D/A converters 4R.

The D/A converters 4R amplify the reference currents Ir supplied from the reference current generator circuit 2R through the MPU 7 and the register 6 by an amount corresponding to the display data to generate drive currents corresponding to luminance of corresponding organic EL elements and to drive output stage current sources 5R connected to the D/A converter circuits 4R, respectively. The output stage current source 5R is constructed with a current mirror circuit (cf. FIG. 2) having a pair of transistors and output drive currents i to the organic EL display panel (anodes of the organic EL elements for R display color) through column side output terminals XR1 to XRm.

A drain of the last transistor Trn of the current mirror circuit 3 is connected to the D/A converter circuit 4R corresponding thereto to drive the latter. The same D/A converter circuit 4R drives the output stage current source 5R correspondingly to the input data, which is set therefor, and the output stage current source 5R supplies an output current Iout to an external output terminal 10*b* of the column driver 10. This output current is used as monitor current for generating similar drive current in a column driver IC provided in a next stage. Alternatively, the monitor current may be derived from one of the output stage current sources 5R provided on B or G color side.

Figure 2:
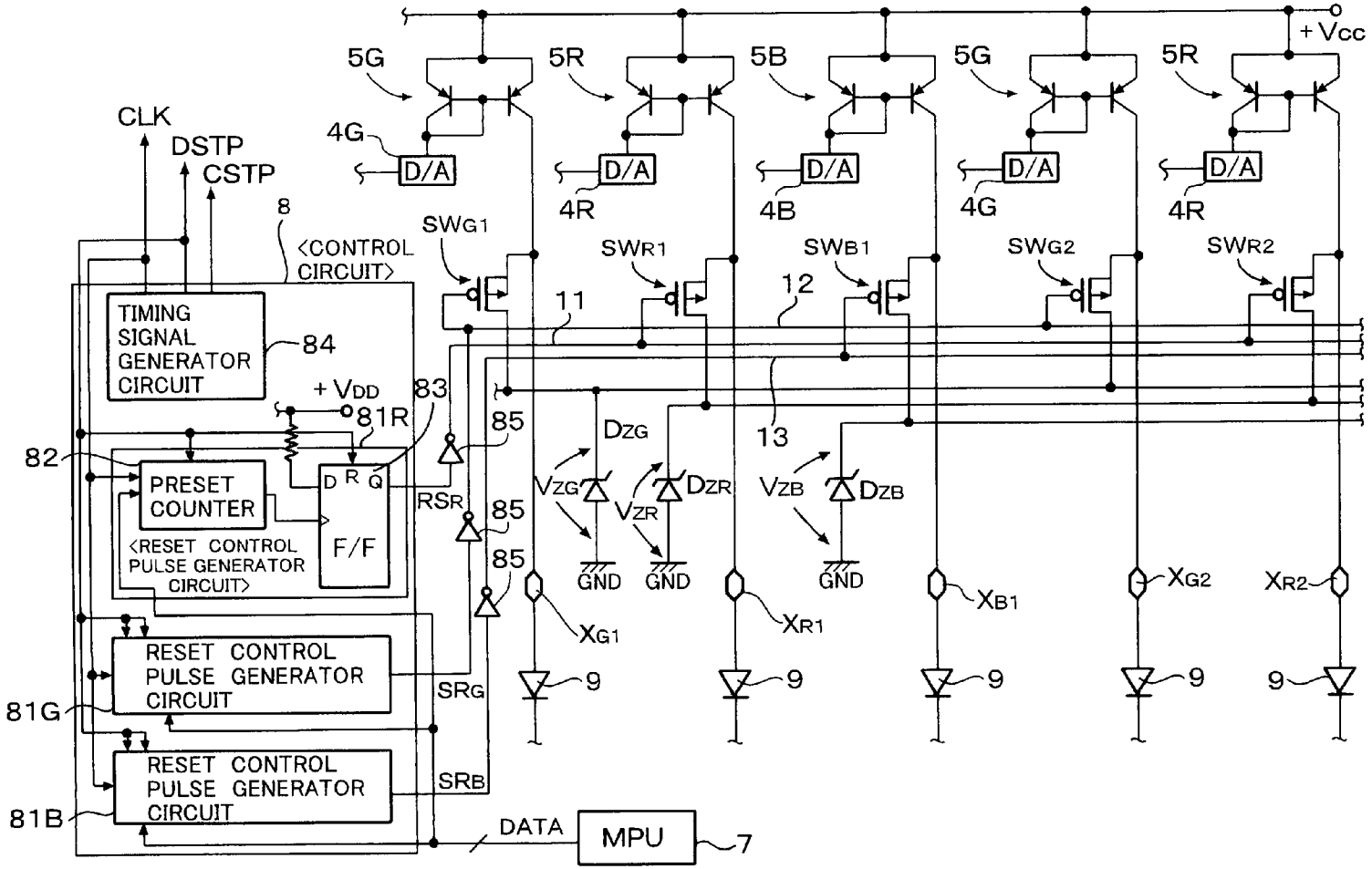
FIG. 2 is a circuit diagram of a control circuit of the organic EL display panel shown in FIG. 1, showing a relation between generation of reset control pulse and constant voltage resetting.

As shown in FIG. 1 and FIG. 2, switch circuits SWR1, SWR2, . . . , SWRm are provided correspondingly to the output terminals XR1, XR2, . . . , XRm for R display color and function to reset the respective output terminals to a constant voltage Vzr. As shown in FIG. 2, each of the switch circuits is constructed with, for example, a P channel MOS transistor having a gate supplied with a reset control pulse Rsr from a control circuit 8 through an inverter 85 and a line 11. The P channel MOS transistors constituting the respective switch circuits have sources connected to the respective output terminals XR1 to XRm and drains grounded through Zener diodes Dzr. Therefore, the transistors are turned ON for the reset time period RT, so that the anodes of the organic EL elements 9 are set to a constant voltage Vzr of the Zener diode Dzr to precharge the organic EL elements 9. In this case, the cathodes of the organic EL elements 9 are grounded.

Similarly, P channel MOS transistors, which constitute switch circuits SWG1, SWG2, . . . , SWGm for G display color, are provided correspondingly to respective output terminals XG1, XG2, . . . , as shown in FIG. 2. Sources of these transistors are connected to output terminals XG1, XG2, . . . , and drains thereof are grounded through Zener diodes Dzg, respectively. Gates of these transistors are connected to a line 12 to receive reset control pulses RSG from a control circuit 8 through the line 12 and other inverter 85.

Similarly, P channel MOS transistors, which constitute switch circuits SWB1, SWB2, . . . , SWBm for B display color, are provided correspondingly to respective output terminals XB1, XB2, . . . , as shown in FIG. 2. Sources of these transistors are connected to output terminals XB1, XB2, . . . , and drains thereof are grounded through Zener diodes Dzb, respectively. Gates of these transistors are connected to a line 13 to receive reset control pulses RSB from a control circuit 8 through the line 13 and other inverter 85.

Incidentally, the output terminals XR1 to XRm take in the form of pads provided on the IC chip and are integrally connected to respective column pins of the organic EL display panel by gold bumps, gold balls, solder bumps or solder balls. Therefore, as shown in FIG. 2, the output terminals XR1 to XRm are integrated with respective column pins. The circuits provided correspondingly to the respective output terminals correspond to the respective column pins (terminal pins).

In FIG. 2, the control circuit 8 includes reset control pulse generator circuits 81R, 81G and 81B provided correspondingly to R, G and B display colors and a timing signal generator circuit 84 having a pixel counter. Since the reset control pulse generator circuits have identical constructions, only the reset control pulse generator circuit 81R will be described in detail.

Although the control circuit 8 is usually provided as an IC outside of the column driver 10, the control circuit may be provided within the column driver 10 as shown in FIG. 2.

The reset control pulse generator circuit 81R is constructed with a preset counter 82 and a flip-flop 83. The preset counter 82 is preset with data supplied from the MPU 7, which is external of the column driver 10, and counts down the preset data according to a clock pulse CLK from the timing signal generator circuit 84. When the count of the preset counter 82 becomes zero, it generates an output pulse, a rising edge of which is supplied to the flip-flop 83 as a trigger signal. Since a data input terminal D of the flip-flop 83 is pulled up, data "1" is set in the flip-flop 83 in response to the trigger signal and a Q output thereof is supplied to the line 11 through the inverter 85 as the reset control pulse RSR.

Incidentally, the flip-flop 83 is reset by the display start pulse DSTP supplied to a reset terminal R thereof from the timing signal generator circuit 84 of the control circuit 8. The count-down of the preset value of the preset counter 82 is performed by every rising edge of the display start pulse DSTP. The preset value may be set in the preset counter by the MPU 7 or by an internal register of the the preset counter 82 correspondingly to the rising edge of the display start pulse DSTP.

Figure 3:
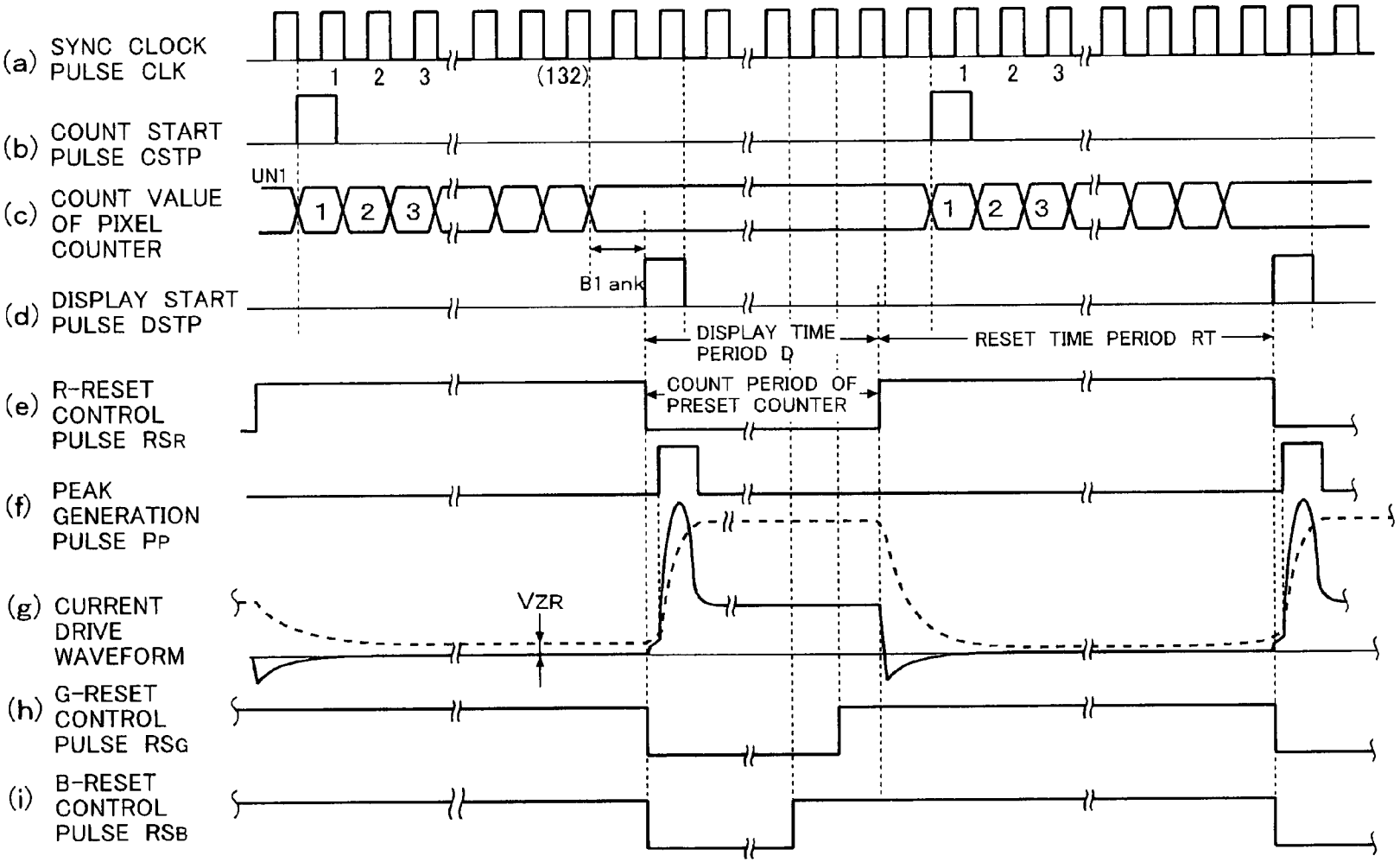
FIG. 3 shows waveforms of current for driving terminal pins and a timing signal for generating the waveforms.

As a result, the reset control pulse generator circuit 81R generates the reset control pulse RSR shown in FIG. 3(*e*). The reset control pulse RSR rises correspondingly to the data for R display color preset in the preset counter 82.

Similarly, the reset control pulse generator circuit 81G generates the reset control pulse RSG shown in FIG. 3(*h*), which rises correspondingly to the data for G display color preset in the preset counter 82.

Similarly, the reset control pulse generator circuit 81B generates the reset control pulse RSB shown in FIG. 3(*i*), which rises correspondingly to the data for B display color preset in the preset counter 82.

Each of the reset control pulses RSR, RSG and RSB is in "H" level in the reset time period RT and is in "L" level in the display time period D with a period of (D+RT). Thus, the reset time period RT is determined by the reset control pulse RSR, which is in "H" level as shown in FIG. 3(*e*). When the display start pulse DSTP becomes "H" level, the display time period RT is started and, simultaneously, the reset time period is terminated. By using, as a reference, a time at which the reset time period is terminated, the down-counts of the preset counters 82 corresponding to the reset control pulses RSR, RSG and RSB are started to determine the timing of a next rise. The display time periods D for the respective display colors are terminated with the rise timings of the reset control pulses.

As a result, the currents for driving the organic EL elements 9 for, for example, R display color, which have waveforms shown by the solid line in FIG. 3(*g*), according to the peak generation pulse Pp shown in FIG. 3(*f*). The dotted line shows the voltage waveform corresponding to the drive current, as mentioned previously.

Incidentally, in the reset time period RT in which the reset control pulses RSR, RSG and RSB shown in FIG. 3(*e*), FIG. 3(*h*) and FIG. 3(*i*) are in "H" level, the setting of various data and the voltage resetting for resetting the anode voltage of the organic EL elements 9 to the predetermined constant voltage, etc., are performed. Particularly, when the reset signals are in "H" level, the display data is set in the display data register 6 provided correspondingly to the respective terminal pins. Therefore, when the number of the terminal pins for each of R, G and B display colors is 132, the "H" time period of each reset control pulse corresponding to 133 clocks or more is required as shown by a pixel counter value in FIG. 3(*c*).

As shown in FIG. 3(*g*), the rising edge of the current drive waveform corresponds to a start timing of the display time period D and the falling edge thereof corresponds to an end timing of the display time period D. Therefore, it is possible to change the display time periods D for R, G and B display colors by setting the widths of the reset control pulses RSR, RSG and RSB correspondingly to the respective display colors. In this embodiment, the display time periods D are determined for the respective display colors by setting preset values in the respective present counters 82 externally of the reset control pulse generator circuits 81R, 81G and 81B and the display luminance of display colors on the display screen is regulated by regulating the display time periods D according to the preset values.

The data preset in the preset counter 82 of the preset control pulse generator circuit 81R is set by the MPU 7 as the value corresponding to R display color and the data preset in the preset counter 82 of the reset control pulse generator circuits 81G and 81B are also set by the MPU 7 as the values corresponding to G and B display colors, respectively. Thus, the reset control pulses RSG and RSB corresponding to G and B display colors, which have different rise timings such as shown in FIG. 3(*h*) and FIG. 3(*i*), are generated. As a result, the rise positions of the reset control pulses RSR, RSG and RSB can be regulated by the data set by the MPU 7.

The data values to be supplied from the MPU 7 and to be set in the preset counters 82 of the reset control pulse generator circuits 81R, 81G and 81B are stored in, for example, a non-volatile memory, etc., in the MPU 7 and then set in the preset counters 82 when the power source of the drive circuit is switched ON. Besides, these data are stored in a non-volatile memory, etc., correspondingly to an input data externally inputted to the MPU 7 externally. Particularly, it is preferable that the data input to the MPU 7 and the data write in the non-volatile memory are performed by inputting the data for respective R, G and B display colors to the MPU 7 through a keyboard and the white balance regulation may be performed on the basis of the data in a test stage, etc., of the products.

In this embodiment, the reset control pulse generator circuit is provided for each of G and B display color to generate the respective reset control pulses. However, since the difference in light emission efficiency between light emitting materials for G and B display colors is small at present, it is possible to use a single reset control pulse generator circuit instead of the two reset control generator circuits to control the reset time periods for both the G and B display colors.

Further, in this embodiment, the reset time period of each display color is set by measuring the display time period with using the preset counter. The preset counter may be constructed with a programmable soft counter. That is, the present invention can use any type preset counter, provided that it can set the reset time period can be set by means of time-measurement.

Further, in this embodiment, the Zener diodes DZR, DZG and DZB are used to generate the precharge voltages for R, G and B display colors. The precharge voltages may be the same. Therefore, a single Zener diode or a constant voltage circuit may be used instead of the Zener diodes DZR, DZG and DZB. Further, a Zener diode may be provided for each output terminal.

What is claimed is:

1. An organic EL element drive circuit for current-driving organic EL elements through terminal pins provided correspondingly to R, G and B display colors of an organic EL display panel in a display time period and resetting terminal voltages of said organic EL elements in a reset time period, according to a timing control signal for regulating the display time period corresponding to one horizontal scan period and the reset time period corresponding to a retrace period of the horizontal scan, said organic EL element drive circuit comprising a pulse generator circuit for generating the timing control signal having the reset time period, which is set according to data set externally of said pulse generator circuit, correspondingly to respective R, G and B display colors, a display luminance of each display color on a screen of said organic EL display panel being regulated according to the data.

2. An organic EL element drive circuit as claimed in claim 1, wherein the reset time period of the timing control signal for R display color is longer than the reset time period of the timing control signal for each of G and B display colors.

3. An organic EL element drive circuit as claimed in claim 2, further comprising a plurality of reference current generator circuits for generating reference currents corresponding to respective R, G and B display colors, output currents supplied to said terminal pins being produced on the basis of the reference currents, wherein display luminance corresponding to each of R, G and B display colors on said screen is regulated by regulating the reference currents.

4. An organic EL element drive circuit as claimed in claim 3, wherein said pulse generator circuits are provided correspondingly to respective R, G and B display colors and the data is inputted externally of said organic EL element drive circuit.

5. An organic EL element drive circuit as claimed in claim 4, wherein each said pulse generator circuit includes a counter for counting clocks the number of which corresponds to the set data and the timing control signal is generated according to the count value of said counter.

6. An organic EL element drive circuit as claimed in claim 5, further comprising first D/A converter circuits provided correspondingly to said terminal pins and current sources for generating output currents for driving said organic EL elements, said first D/A converter circuits for respective R, G and B display colors receiving the reference currents corresponding to respective R, G and B display colors or drive currents generated on the basis of the reference currents and display data, D/A converting the display data according to the reference currents or the drive currents and driving said current sources according to the current obtained by the D/A conversion, switch circuits provided correspondingly to output terminals of said current sources for generating the output currents, each said organic EL element being reset when said switch circuit corresponding thereto is turned ON according to said timing control signal.

7. An organic EL element drive circuit as claimed in claim 6, wherein said current sources are constructed with a current mirror circuit, said reference current generator circuits include three reference current generator circuits provided correspondingly to respective R, G and B display colors, a value of the reference current generated by each said reference current generator circuit being set according to data set externally of said reference current generator circuit.

8. An organic EL element drive circuit as claimed in claim 7, wherein each said reference current generator circuit includes a second D/A converter circuit for D/A converting the data set externally of said reference current generator circuit, the data being inputted externally of said organic EL element drive circuit.

9. An organic EL element drive circuit as claimed in claim 6, wherein the timing control signals for respective G and B display colors are identical.

10. An organic EL element drive circuit as claimed in claim 9, wherein said current sources are constructed with a current mirror circuit, said reference current generator circuits include three reference current generator circuits provided correspondingly to respective R, G and B display colors, a value of the reference current generated by each said reference current generator circuit being set according to data set externally of said reference current generator circuit.

11. An organic EL element drive circuit as claimed in claim 10, wherein each said reference current generator circuit includes a second D/A converter circuit for D/A converting the data set externally of said reference current generator circuit, the data being inputted externally of said organic EL element drive circuit.

12. An organic EL element drive circuit as claimed in claim 11, wherein said reference current generator circuits for respective G and B display colors are constructed with a single reference current generator circuit and the timing control signal for G and the timing control signal for B are a same pulse.

13. An organic EL display device comprising an organic EL element drive circuit as claimed in claim 1.

14. An organic EL display device as claimed in claim 13, wherein said organic EL element drive circuit is provided as an IC chip and said control circuit is provided as an IC chip externally of said organic EL element drive IC.

15. An organic EL display device as claimed in claim 14, further comprising a processor and the data set in said pulse generator circuits and the data set in said second D/A converter circuits are supplied by said processor according to data inputted to said processor.

16. An organic EL display device as claimed in claim 15, wherein said pulse generator circuit is a programmable pulse generator circuit for generating a pulse having programmable width.

* * * * *